United States Patent [19]

Gale

[11] 4,014,144

[45] Mar. 29, 1977

[54] ADAPTOR FOR CONVERTING AN L-SHAPED ROD INTO AN EARTH ANCHOR

[75] Inventor: Jack D. Gale, Crowley, Tex.

[73] Assignee: Clare P. Tubbs, Richardson, Tex.

[22] Filed: July 28, 1975

[21] Appl. No.: 599,763

Related U.S. Application Data

[62] Division of Ser. No. 435,224, Jan. 21, 1974, Pat. No. 3,896,890.

[52] U.S. Cl. ..... 52/157

[51] Int. Cl.[2] ..... E04D 5/80

[58] Field of Search ..... 52/157; 61/53.68

[56] References Cited

UNITED STATES PATENTS

| | | | |
|---|---|---|---|
| 818,061 | 4/1906 | Toy et al. | 52/157 |
| 1,940,938 | 12/1933 | Chance | 52/157 |
| 2,234,907 | 3/1941 | Williams | 52/157 |

*Primary Examiner*—Ernest R. Purser
*Attorney, Agent, or Firm*—Charles W. McHugh

[57] ABSTRACT

A device adapted to serve as the anchor base of a screw-type anchor, wherein the base is intended to be embedded in the earth with a rod extending from the base to the earth's surface. (Placing the anchor in the earth is typically accomplished by rotating it with the aid of a mandrel or the like.) The device includes a generally helical shaped flight having a length of at least one full turn. The flight has an axial opening along its center, with the diameter of the opening being larger than the diameter of an L-shaped anchor rod. Means are provided to firmly connect the helical flight to the anchor rod. One such means includes a reinforcing collar which is rigidly fixed in the axial opening of the flight. Appropriate coupling means are provided to hold the anchor rod and the flight together, so that they may be rotated as a unit so as to burrow the anchor in the earth. Another means for holding the anchor rod and the flight together includes a tube or the like to restrain the bottom end of the anchor rod from rotating with respect to the flight; the flight includes only one complete turn, and the upright portion of the rod may be fixedly held to the flight by virtue of "wedging" it within the axial opening of the flight.

3 Claims, 5 Drawing Figures

ADAPTOR FOR CONVERTING AN L-SHAPED ROD INTO AN EARTH ANCHOR

This is a division of Ser. No. 435,224 filed Jan. 21, 1974, now U.S. Pat. No. 3,896,890.

This invention relates to anchoring things to the earth without first digging a hole. It relates in general to anchors adapted to be inserted into the earth, and more particularly it relates to a screw-type anchor and a means for installing the same in the earth by rotating it and not unduly disturbing the surrounding soil.

There are many occasions when it is desirable to provide an anchor in the earth with one end protruding above the soil, to which can be secured ropes, guy lines, straps and the like. A very common use for such anchors is in securing the ends of straps and cables with which to hold mobile homes securely to the earth (when they are not being moved). Exemplary of such anchors are those shown in U.S. Pat. No. 3,747,288 to Grimelii entitled "Double Anchorage Clamp".

Under some circumstances, a person arriving at an installation site will not have any prior knowledge of the type of soil into which an anchor is to be placed. That is, he may not know whether the soil is loose enough so that a helical anchor could be rotated to a depth of 6 or 7 feet, or whether the soil may be so firm that turning a helical anchor to a depth of 3 feet is essentially all that can be done—with the same amount of torque that could drive a similar anchor many feet into sandy soil. When an istallation crew faces the dilemma of not knowing what kind of soil is likely to be encountered at a remote site, then the only practical choice in the past has been to carry an extensive inventory of anchors having shanks with a wide range of lengths. That is, if an installation crew has the assignment of placing 10 anchors in the ground, the truck carrying the installation materials would advantageously have at least 10 anchors with short shanks, at least 10 anchors with medium shanks, and at least 10 anchors with long shanks. After arriving at a job site, the crew would then select the anchor having the appropriate length for the soil conditions they encounter. Of course, anchors that are fabricated with a flight welded to a shank becomes somewhat of a storage problem, in that they are relatively bulky and sometimes awkward to both store and remove from storage. Accordingly, it is an object of this invention to provide a device which is readily adapted for combination with a rod of essentially any desired length, whereby an earth anchor may be "made up" in the field with components that are relatively compact and easy to store.

Another object is to provide a device which may be readily combined with a commercially available anchor bolt so as to make said anchor bolt functional in a way that it previously had not been.

These and other objects will be apparent from a reading of the specification and the claims appended thereto, as well as the attached drawings.

A fairly common anchor is illustrated in the U.S. Pat. No. 3,148,510, to Sullivan, wherein a shank or rod is provided at its opposite ends with a flight and a threaded head (to which a rope or the like is subsequently attached). It has been common to manufacture the flights by taking a metal disc of a desired outer diameter, cutting a small hole in the center to accommodate the shank, and then making a single radial cut from the hole outward to the periphery of the disc. The disc is then bent such that the two ends (which were created when the radial cut was made) are then widely separated. The disc is then slid over one end of the shank and welded thereto. A flight made from such a round piece of sheet metal is frequently called a spoon; perhaps one reason for such a description is that such flights tend to churn and lift the soil as they are rotated into the earth. In contrast to such commonly used "spoons", a preferred flight of this device is a helical flight. The term "helical", of course, refers to a curve such as would be obtained by winding a thread around cylinder in such a manner that there would be a uniform amount of advance with each revolution. In contrast to "spoons", helical flights will cut through the ground during insertion but will not unduly disturb or significantly remove dirt from the hole.

Helical flights for earth anchors can be made in much the same way that helical conveyor stock is prepared, and conventional machinery can be used. Conventional helical conveyor stock is formed from long and relatively narrow strips or skelp. The skelp size is selected in accordance with the desired outer diameter of the flight, as well as the diameter of the shank to which the flight will be attached. For an examplary anchor which might be installed for anchoring mobile homes, skelp having a thickness of ¼ inch and a width of 2½ inches is passed through a set of serially arranged dies, which twist or turn the long strip until it forms the desired helix. The formed helix will normally still have its ¼ inch thickness on its inner side, but it will be thinned to about ⅛ inch or less on its outer side; this is particularly beneficial in that it effectively forms a sharpened blade for cutting through the soil. The relatively long piece of helical stock is then cut into small sections of about one full turn and placed on one end of a shank and secured thereto, such as by welding.

Figure 1:
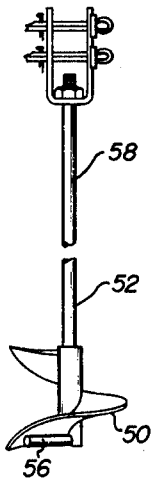
FIG. 1 is a front elevation view of an anchor according to the invention.
Figure 2:
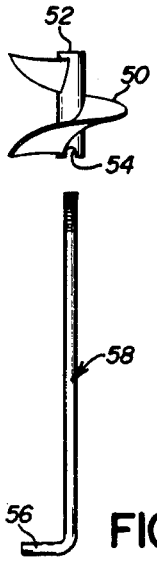
FIG. 2 is a view of the anchor shown in FIG. 1, prior to assembly.
Figure 3:
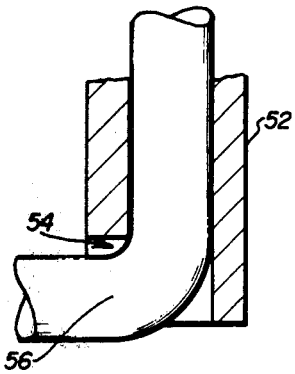
FIG. 3 is a partial, enlarged view of the base of the anchor bolt shown in FIG. 1.

In the past, prior art anchors have been described as having a shank and a welded flight at the bottom end thereof. In contrast to such prior art anchors, the anchor usable with this invention has been more broadly described as one where the flight is "secured" to the bottom end of a shank. The term "secured" has been used for the reason that it encompasses (besides welding) a mechanical connection including threads and/or interlocking pieces. In the embodiment of the invention shown in FIGS. 1–3 the flight 50 is provided with a central collar 52 or the like having a recess 54 into which an L-shaped foot 56 on an anchor bolt 58 may be engaged. In installation of such an anchor, the flight 50 would be inserted over the elongated shank of a L-shaped anchor 58, and the flight would be slid to the bottom where the recess 54 would engage the short leg of the L-shaped bolt, as shown in FIG. 3. In order that the foot 56 will not unduly interfere with downward rotation of an anchor, it is preferred that the recess 54 in the bottom end of the collor 52 be located so that the foot will nest immediately next to the bottom surface of a flight 50, as shown in FIG. 1. An installation tool or mandrel would then be placed over the shank and a protuberance or the like on the mandrel would engage the top portion of the flight (or its central collar), so that torque for twisting the flight into the earth can be directly applied to the vicinity of the flight. The weight of the tubular mandrel as it sits on the collar 52 will keep the collar and the foot 56 mechanically engaged, so no welding is really necessary. A principal advantage of a construction of this embodiment is it permits an L-shaped shank of any desired length to be combined at will with a special flight 50, so that a person might have shanks of 2 feet, 4 feet, 8 feet, etc., available for his use—depending on the kind of soil he encounters when he arrives at a job site.

Figure 4:
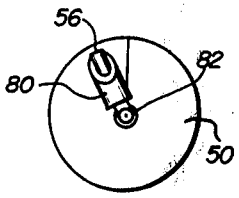
FIG. 4 is a bottom view of a means for mating a separable flight to an anchor bolt.
Figure 5:
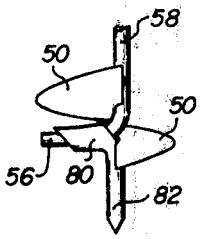
FIG. 5 is an elevation view of the device shown in FIG. 4, and additionally showing a short spike to foster entrance of the flight into the ground.

In use of the invention, it is anticipated that an operator will arrive at a work site with an installation apparatus loaded in the back of a pickup truck or the like. The operator will then remove the apparatus from his vehicle and move it to a desired anchoring spot. He will then make a decision as to what length anchor is to be installed, and select an appropriate anchor bolt from his inventory. Assuming his anchor bolt does not have a flight, he would first mate such a flight to the anchor bolt. One way of mating the two is shown in FIG. 4, wherein a short tubular piece 80 is securely welded to the bottom surface of the flight 50. An L-shaped foot 56 may be first inserted in the tube 80 and then twisted so that it assumes a position like that shown in FIG. 1; once it begins to turn in the earth, it cannot be separated. He will then insert the anchor bolt (which has no head on it at this time) inside the installation tube or mandrel. He would then place a selected power drive unit on top of the mandrel, and energize the same to provide torque to the mandrel; the power unit will simply screw the anchor into the earth. A head or the like would then be screwed on top of threads provided for that purpose on the top of the anchor bolt 58. The installation apparatus would then be moved to another work site, where the process would be repeated.

While only the preferred embodiments of the invention have been disclosed in great detail herein, it will be apparent to those skilled in the art that modifications thereof can be made without departing from the spirit of the invention. Thus, the specific structures shown herein are intended to be exemplary and are not meant to be limiting, except as described in the claims appended hereto.

What is claimed is:

1. A device adapted to serve as the anchoring base of a screw-type anchor wherein the base is adapted to be embedded in the earth with a rod extending from the base to the earth's surface, comprising:

a. a generally helical-shaped flight having a length which includes at least one full turn;

b. an axial opening along the center of the flight, said opening having a diameter significantly larger than the diameter of the shank of an L-shaped anchor bolt;

c. a reinforcing collar having a smooth round bore permanently affixed within the axial opening, with the interior diameter of the collar being only slightly larger than the shank's diameter, whereby the collar and the bolt's shank are slidably connected by passing the shank through the collar; and d. coupling means for causing the foot of the L-shaped anchor bolt to selectively engage the collar after the bolt's shank is inserted through said collar, with said coupling means including a recess in the bottom edge of said collar which is sized to receive the foot of the L-shaped bolt so as to hold the foot against rotation with respect to the collar, and the location of the recess being such as to cause the bolt's foot to lie immediately adjacent a surface of the flight, whereby the bolt and the flight may be selectively coupled and rotated as a unit during installation of the anchor in the earth.

2. A device adapted to serve as the anchoring base of a screw-type anchor wherein the base is adapted to be embedded in the earth with a rod extending from the base to the earth's surface, comprising:

a. a generally helical-shaped flight having a length which includes at least one full turn;

b. an axial opening along the center of the flight, said opening having a diameter slightly larger than the diameter of the anchor rod; and c. a generally horizontal collar permanently fixed to the flight and extending radially from the axial opening toward the periphery of the flight, with said collar terminating on its inner end at a location to receive the L-shaped foot of an anchor bolt, with at least a portion of the flight lying above the horizontal collar in a location to bear against the anchor bolt's shank and prevent rotation of the foot within the collar, whereby the anchor bolt may be rigidly held so that its longitudinal axis coincides with the axis of the flight.

3. The device as claimed in claim 2 wherein a spike is permanently secured to the bottom of the flight, said spike lying along the longitudinal axis of the flight, whereby the entrance of the flight into the ground is fostered by first pressing the spike into the ground.

* * * * *